US008505431B2

(12) United States Patent
Hines

(10) Patent No.: US 8,505,431 B2
(45) Date of Patent: Aug. 13, 2013

(54) FIREARM SUPPRESSOR WITH CROSSBARS AND INSERTS

(75) Inventor: Tom Hines, Kuna, ID (US)

(73) Assignee: Tactical Solutions, Boise, ID (US)

( * ) Notice: Subject to any disclaimer, the term of this patent is extended or adjusted under 35 U.S.C. 154(b) by 0 days.

(21) Appl. No.: 13/342,198

(22) Filed: Jan. 2, 2012

(65) Prior Publication Data

US 2013/0175113 A1 Jul. 11, 2013

Related U.S. Application Data

(62) Division of application No. 12/364,428, filed on Feb. 2, 2009, now Pat. No. 8,087,338.

(60) Provisional application No. 61/025,450, filed on Feb. 1, 2008.

(51) Int. Cl.
*F41A 21/00* (2006.01)

(52) U.S. Cl.
USPC ..... 89/14.4; 89/14.3; 181/223

(58) Field of Classification Search
USPC ..... 42/1.06, 79; 181/223; 89/14.4, 89/14.3
See application file for complete search history.

(56) References Cited

U.S. PATENT DOCUMENTS

| | | | | | |
|---|---|---|---|---|---|
| 1,605,864 | A * | 11/1926 | Steinegger | ..... | 89/14.3 |
| 3,385,164 | A * | 5/1968 | Hubner et al. | ..... | 89/14.4 |
| 4,291,610 | A * | 9/1981 | Waiser | ..... | 89/14.4 |
| 4,576,083 | A * | 3/1986 | Seberger, Jr. | ..... | 89/14.4 |
| 4,588,043 | A * | 5/1986 | Finn | ..... | 181/223 |
| 4,907,488 | A * | 3/1990 | Seberger | ..... | 89/14.4 |
| 4,930,396 | A * | 6/1990 | Johnson | ..... | 89/14.3 |
| 4,974,489 | A * | 12/1990 | Fishbaugh | ..... | 89/14.4 |
| 5,036,747 | A * | 8/1991 | McClain, III | ..... | 89/14.3 |
| 5,136,923 | A * | 8/1992 | Walsh, Jr. | ..... | 89/14.2 |
| 5,164,535 | A * | 11/1992 | Leasure | ..... | 89/14.4 |
| 5,413,189 | A * | 5/1995 | Browning et al. | ..... | 181/268 |
| 6,079,311 | A * | 6/2000 | O'Quinn et al. | ..... | 89/14.4 |
| 6,302,009 | B1 * | 10/2001 | O'Quinn et al. | ..... | 89/14.4 |
| 6,308,609 | B1 * | 10/2001 | Davies | ..... | 89/14.4 |
| 6,374,718 | B1 * | 4/2002 | Rescigno et al. | ..... | 89/14.4 |
| 6,425,310 | B1 * | 7/2002 | Champion | ..... | 89/14.3 |
| 6,575,074 | B1 * | 6/2003 | Gaddini | ..... | 89/14.4 |
| 7,207,258 | B1 * | 4/2007 | Scanlon | ..... | 89/198 |
| 7,237,467 | B1 * | 7/2007 | Melton | ..... | 89/14.4 |
| 7,308,967 | B1 * | 12/2007 | Hoel et al. | ..... | 181/223 |
| 7,412,917 | B2 * | 8/2008 | Vais | ..... | 89/14.4 |
| 7,516,690 | B2 * | 4/2009 | McClellan | ..... | 89/14.4 |
| 7,587,969 | B2 * | 9/2009 | Silvers | ..... | 89/14.4 |
| 7,789,008 | B2 * | 9/2010 | Petersen | ..... | 89/14.4 |
| 7,832,323 | B1 * | 11/2010 | Davies | ..... | 89/14.4 |
| 8,087,338 | B1 * | 1/2012 | Hines | ..... | 89/14.4 |
| 2009/0193963 | A1 * | 8/2009 | Poulsen | ..... | 89/14.2 |
| 2010/0000398 | A1 * | 1/2010 | Silvers | ..... | 89/14.4 |

* cited by examiner

*Primary Examiner* — Michael David
(74) *Attorney, Agent, or Firm* — Forrest Law Office, P.C.

(57) ABSTRACT

A firearm noise suppressor having an internal base frame member with a plurality of inserts mounted thereto. In one form the suppressor is provided with a slip chamber allowing gas to be forwarded to a longitudinally forward chamber for pre-compression of gas therein.

11 Claims, 16 Drawing Sheets

FIREARM SUPPRESSOR WITH CROSSBARS AND INSERTS

RELATED APPLICATIONS

This application is a divisional of application Ser. No. 12/364,428, filed on Feb. 2, 2009, now U.S. Pat. No. 8,087,338, which claims the benefit of U.S. Provisional Application No. 61/025,450, filed Feb. 1, 2008.

BACKGROUND OF THE DISCLOSURE

Suppressors have been utilized with firearms to reduce the noise from the expanding gases expelled from the muzzle region of a barrel. In general, the operational element of a suppressor is to absorb/properly direct the kinetic energy of the expanding gases. Many prior art types of suppressors utilized a plurality of passageways such as a steel wool like arrangement. Such embodiments are not only difficult to clean and maintain but further provide a great deal of surface area which may have difficulty withstanding the highly eroding nature of the high pressure and very hot gases.

Other prior art references utilize a unitary type structure of a single piece of metal to form chambers. However, the prior art systems lack a robust embodiment of having a frame member with inserts configured to fit therein that are designed to properly direct and absorb the kinetic energy of the expanding gases and have a lifespan of a sufficient number of rounds passing therethrough.

SUMMARY OF THE DISCLOSURE

Disclosed herein is a firearms noise suppressor having a base frame with a longitudinally forward region and a longitudinally rearward region. The base frame further has a central longitudinal axis, the base frame providing a plurality of insert mount locations spaced longitudinally along the base frame.

A plurality of inserts are attached to the base frame at the insert mount locations. The plurality of inserts having a projectile entrance portion and a projectile exit portion. A shroud positioned around the base frame and defining in part a primary chamber having sub-chambers between the insert mount locations of the base frame. A containment cap can position the shroud around the base frame. The inserts comprise an annular central mount and the area from the annular central mount to the projectile entrance portion the plurality of inserts have an annular concave surface therearound. Further between the annular central mount and the projectile entrance portion of the inserts there is a surface defining a relief passage. In this form the surface defining the relief passage of the inserts provides a passageway to a surface defining a secondary chamber. The secondary chamber can be comprised of discrete subchambers separated by a baffle wall. In one form the baffle wall has a sinusoidal-type shape substantially perpendicular to the central longitudinal axis.

In other forms the base frame comprises surfaces defining a primary chamber where sub-chambers are defined between the insert mount locations of the base frame. The sub-chambers can be defined by a first oblique surface which provides a slant away from the central longitudinal axis from a longitudinal rearward portion of the sub-chamber to a longitudinal forward portion of the sub chamber. In another form a third chamber region is defined having a plurality of sub-chambers that are opposing the first oblique surface positioned radially outward of the first oblique surface. A surface defining an access vent provides communication in the primary chamber to this third chamber region.

In one plurality of inserts are removable from the base frame and can be replaced in another form the inserts are welded therein. Further, the plurality of inserts can be comprised of a harder metal than that of the base frame.

Further disclosed herein is a suppressor device operatively configured to be attached to a firearm configured for shooting a projectile. The suppressor device has a suppressor body defining a first primary expansion chamber and a second primary expansion chamber where the second primary expansion chamber is positioned longitudinally forward of the first primary expansion chamber. The first and second primary expansion chambers having a projectile passage positioned therebetween to provide communication between the chambers.

There is a surface defining a passageway from the first primary expansion chamber to a slip chamber where the slip chamber provides communication to the longitudinally forwardly positioned second primary expansion chamber for expelling gas therein. The slip chamber is in communication with an advance port in communication with the second primary expansion chamber. The slip chamber provides for communication between the first and second primary expansion chambers to allow compressed gas to flow from the first expansion chamber to the second expansion chamber to preload the second expansion chamber with compressed gas prior to the entry of the projectile therein.

In one form the suppressor body comprises a base body and a plurality of inserts. The insert positioned in the second expansion chamber can have a preload port which is in substantial alignment with the advance port of the slip chamber. The second primary expansion chamber can have a port providing communication to a capacitance chamber. The capacitance chamber can be positioned at a substantially radially opposite location to the slip chamber. Further, the capacitance chamber provides a surface defining a bleed-in vortex port which is positioned at an offset location with respect to an insert positioned in the second primary expansion chamber. Other elements of the disclosed designs are shown in detail herein and further claimed broadly in the appended claims.

BRIEF DESCRIPTION OF THE DRAWINGS

FIG. 13 shows a side view of the base body generally illustrating the concept of the gaseous flow there through;

DESCRIPTION OF THE PREFERRED EMBODIMENTS

With the foregoing general description in place, there will now be a more detailed discussion of the various embodiments showing the sound suppressor device concept.

Figure 1:
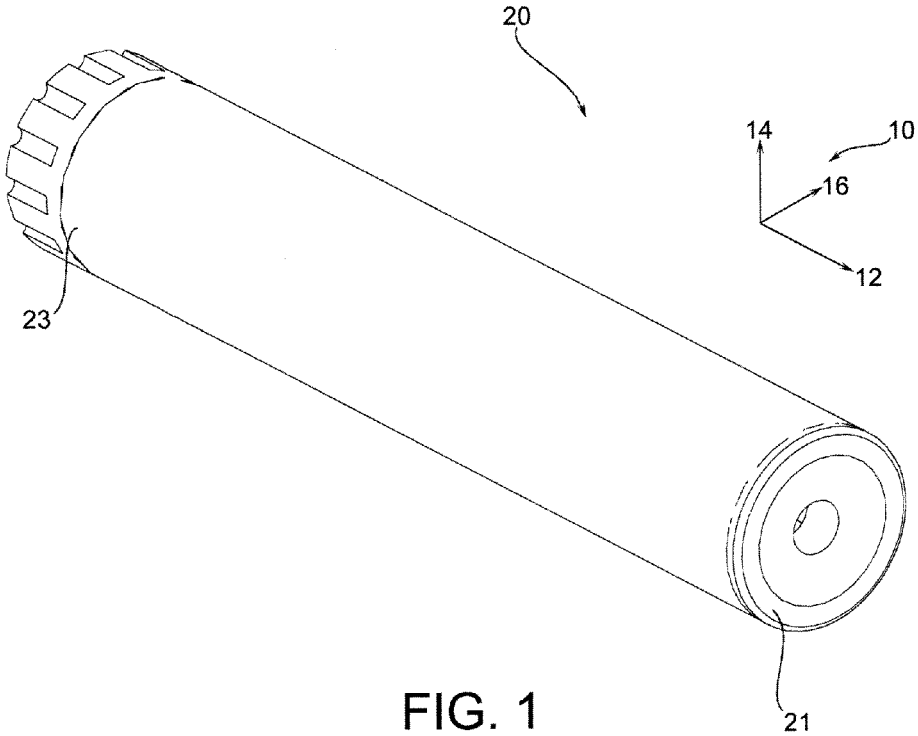
FIG. 1 shows a noise suppressor device.

FIG. 1 shows a sound suppressor device 20 generally having a forward region 21 and a longitudinal rearward region 23. As shown in FIG. 1, an axes system 10 is defined where the axis 12 indicates a longitudinal axis and the axes 14 and 16 respectively define a vertical and lateral axis, wherein each of these directions point radially outwardly from the central longitudinal axis 12' as shown in FIG. 2.

Figure 2:
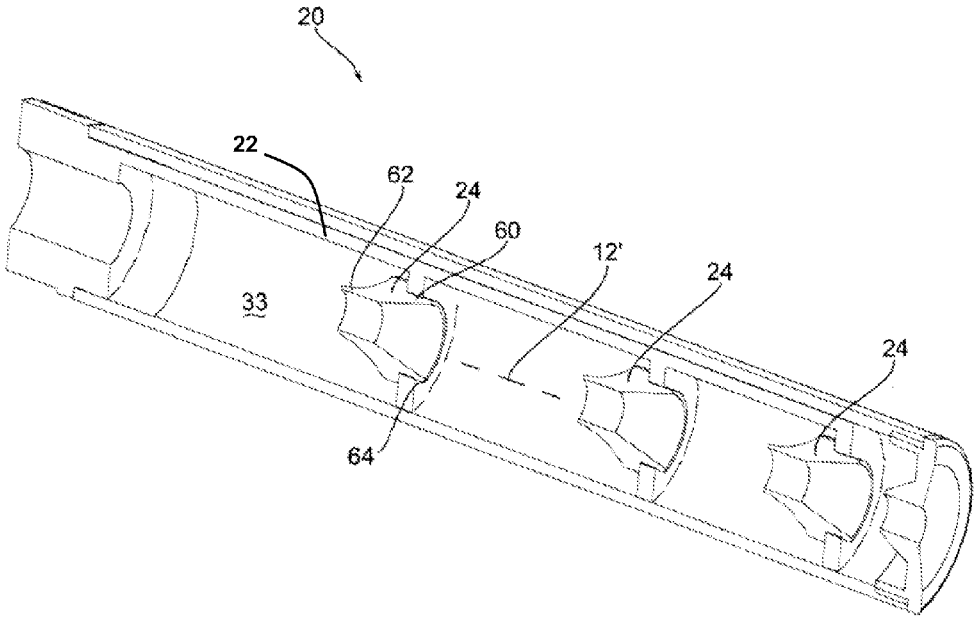
FIG. 2 shows a sectional view of a noise suppressor device.

As shown in FIG. 2 there is a cross-sectional isometric view of a sound suppressor device 20. In general, the suppressor device 20 comprises a base frame 22 and a plurality of inserts 24.

Figure 3:
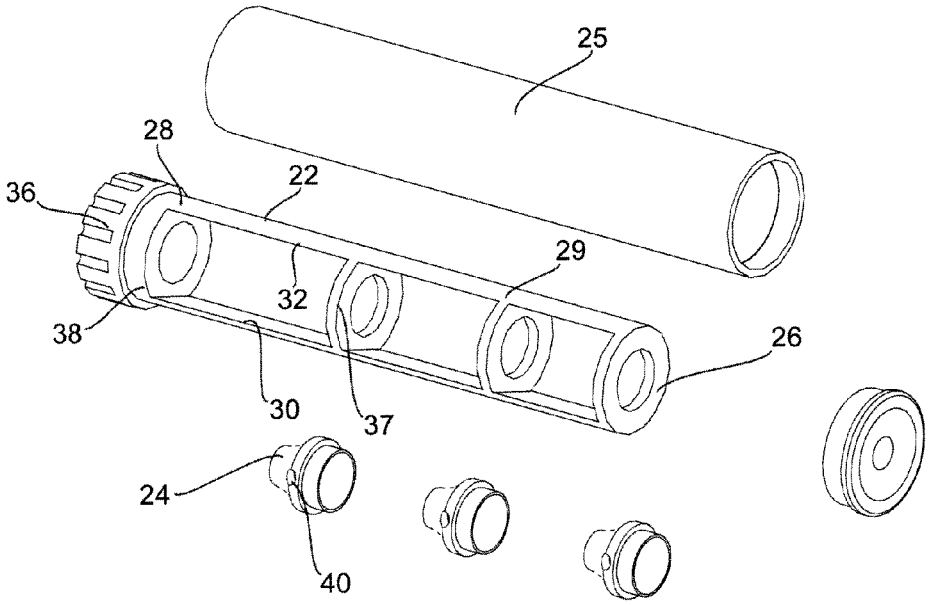
FIG. 3 shows an exploded view of one form of a noise suppressor device.

The base frame 22 itself generally comprises a longitudinally forward region 26 and a longitudinally rearward region 28 as shown in FIG. 3. The frame 22 has a plurality of cross bar regions 37 which are operatively configured to house the inserts 24 and operate as insert mount locations. FIG. 3 further shows surfaces 30 defining cross-sectional openings 32 providing for positioning the respective inserts 24 therein. In one form, the frame 22 is provided with openings on the lateral side, for example, positioned at the approximate location at 29 which are provided with set screws to hold the inserts. In the longitudinally forward region 26 in one form a threaded end cap 36 can be provided. In one form of utilizing the suppressor device 20, the device 20 is fitted within a shroud 25 having a tubular inner surface where the suppressor is fitted in close engagement therewith and the longitudinally rearward region 28 is abutted towards a muzzle portion of a barrel.

As shown in FIG. 3, it can be appreciated that in one form the base frame 22 can be made by excavating out material to form the primary chamber to fit the plurality of inserts 24 therein. Further, one form of manufacture can include simply drilling out or otherwise removing material to form the insert mount locations.

Figure 7:
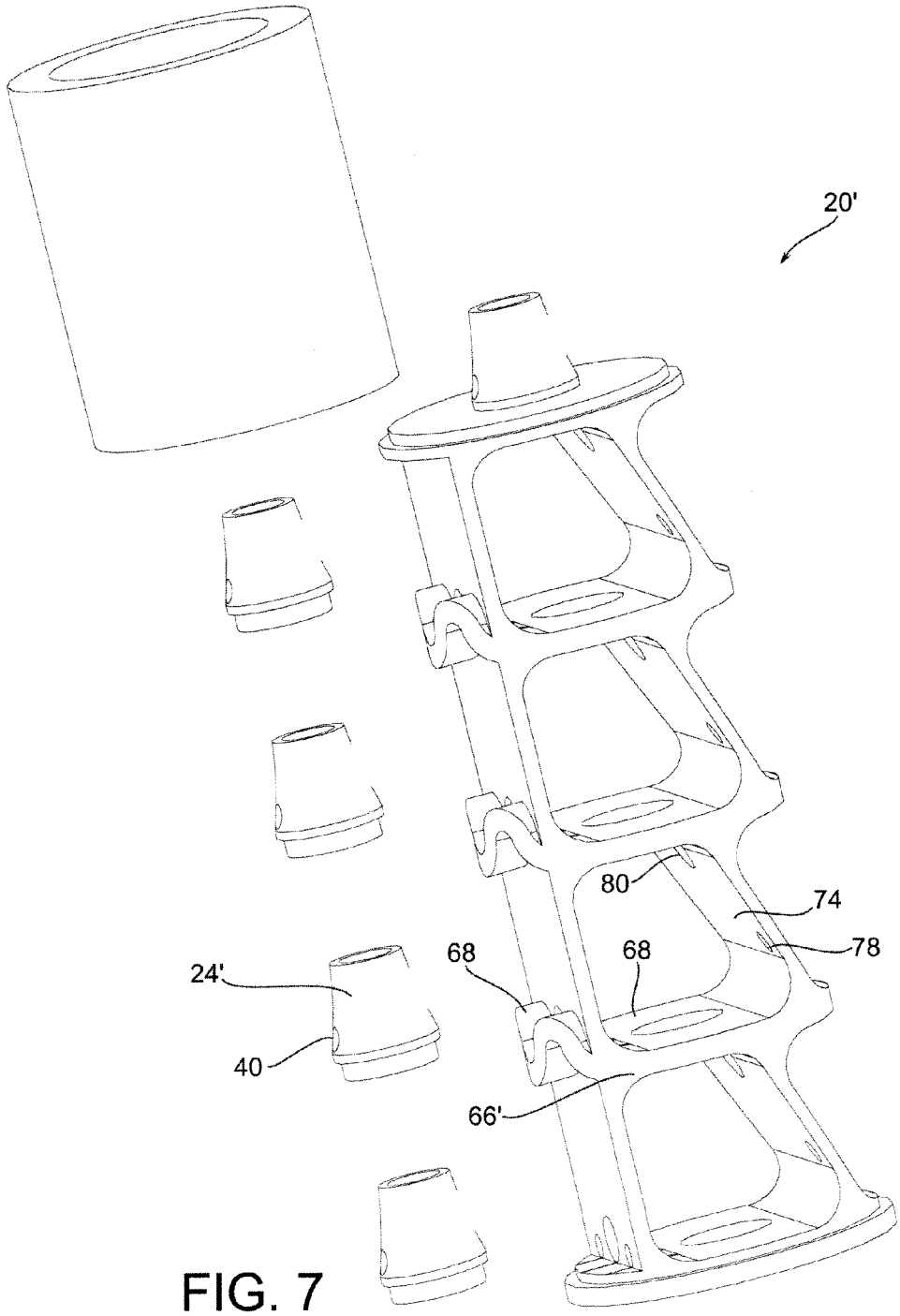
FIG. 7 shows an exploded view of a second embodiment.

As shown in FIGS. 2 and 7, there is shown two types of suppressor units indicated at 20 and 20'. The suppressor 20 is shown where the end cap 36 is provided with the threaded region 38 in one form. It can be further seen in the right hand portion of FIG. 3 that each of the insert members 24 (or at least one of them in one form) in this opening defined by a surface indicated at 40 is provided to provide a turbulent-like effect as the bullet projectile passes through the inner chamber region 46 (see FIG. 5) as described further herein.

Figure 4:
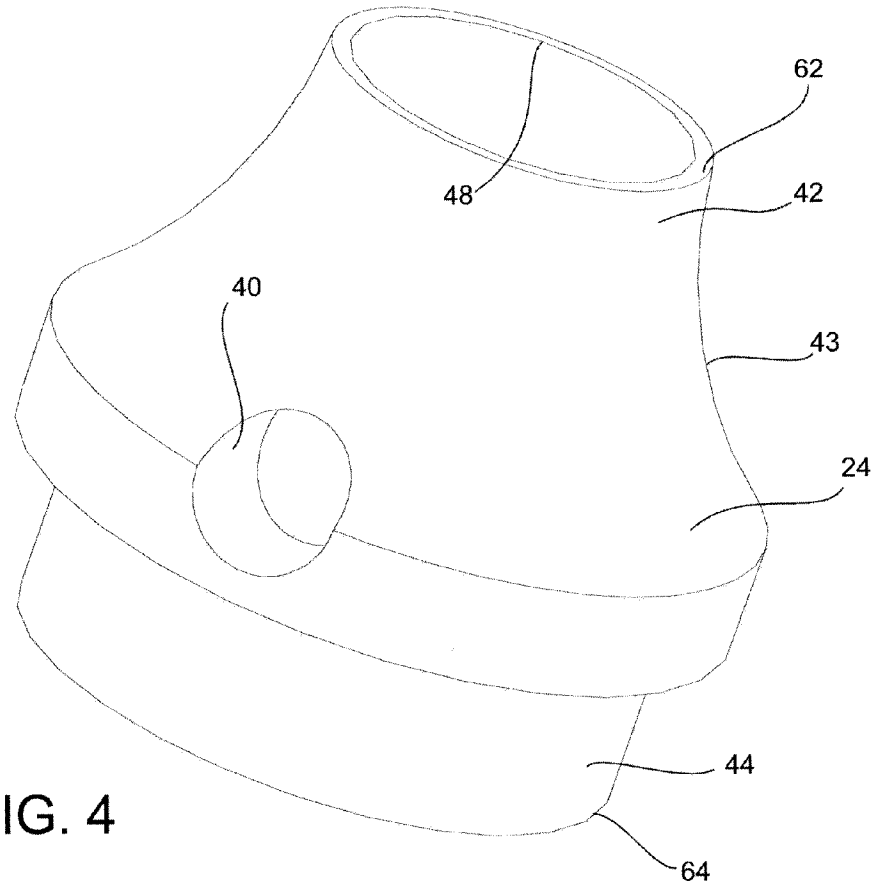
FIG. 4 shows an isometric view of one form of an insert.
Figure 5:
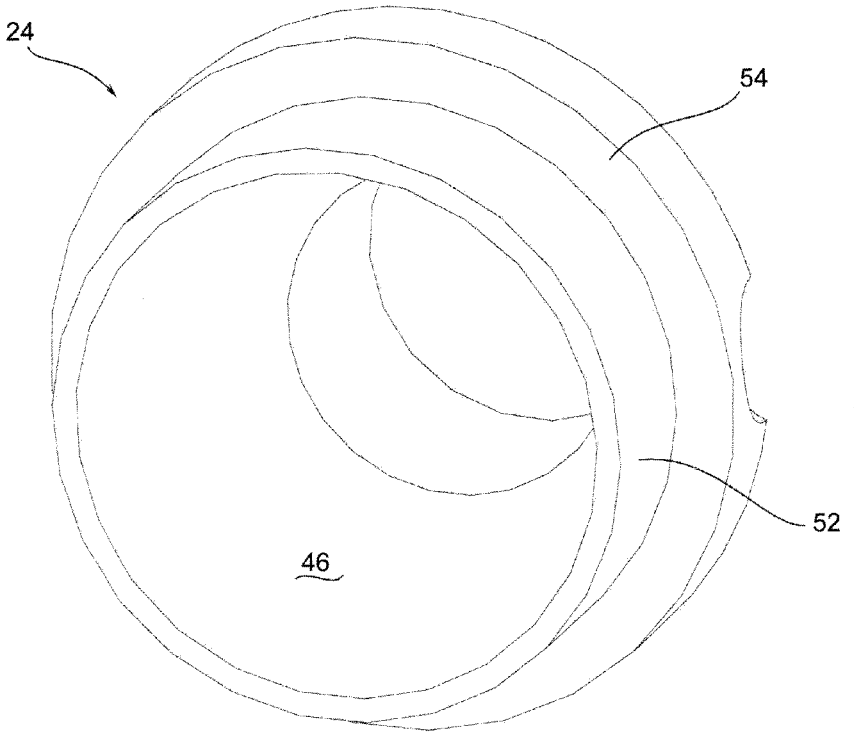
FIG. 5 shows a rearward view of an insert which would be positioned in the longitudinally forward portion of the suppressor device.

Now referring to FIG. 4, there is shown an isometric view of an insert 24. In general, the insert 24 has a longitudinally rearward portion 42 and a longitudinally forward portion 44. As shown in FIG. 5 there is a view from a longitudinally forward portion showing the chamber region 46.

Referring back now to FIG. 4, it can be appreciated that the longitudinally rearward region 42 as shown in, for example, FIG. 2 is adapted to have a projectile enter through the rearward conical base 48. As shown in FIG. 2, the bullet leaving the end portion of the barrel first enters the insert or otherwise the longitudinally rearward portion of the suppressor device 20 indicated that 24'. The rear conical base 48 is shown wherein the bullet passes through the chamber region which in one form as shown in FIG. 5 expands radially outwardly.

As shown in FIG. 4, present analysis indicates that expanding gas extending through the surface to find the opening 40 may create an internal turbulent like affect within the internal chamber region indicated a 33 in FIG. 1.

Figure 6:
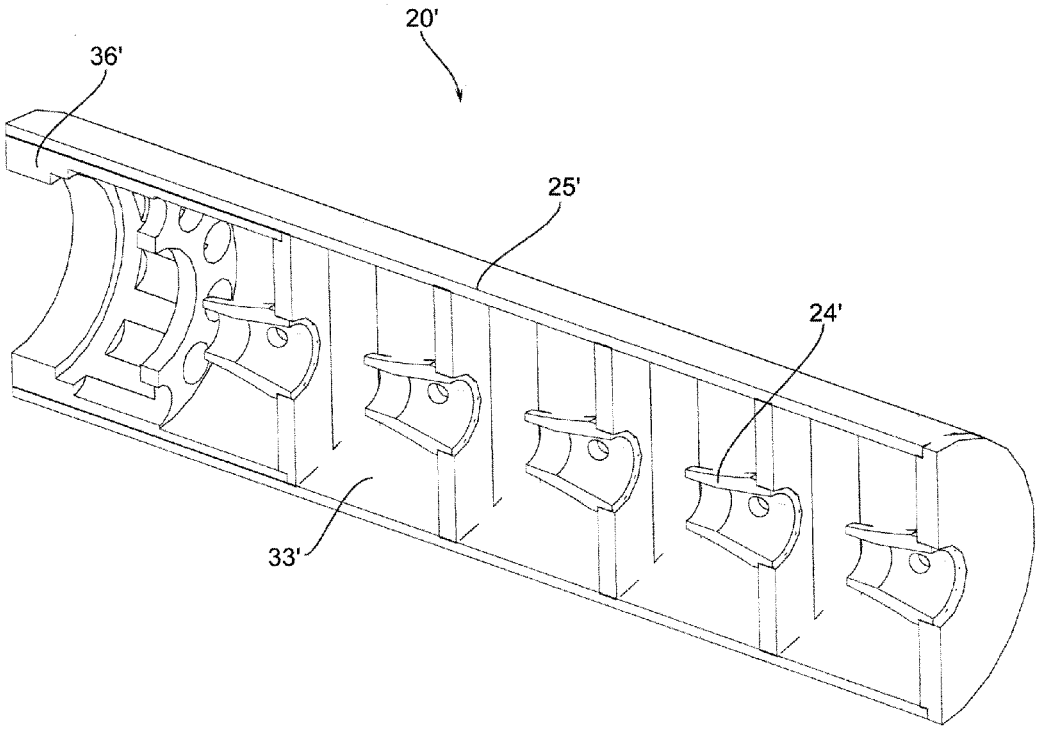
FIG. 6 shows a cross-sectional view of another embodiment of a sound suppressor insert.

In one form as shown in FIG. 3, three internal chambers can be utilized, but of course a variety of number chambers can be incorporated (e.g. 2-10) and in some forms a single chamber could be utilized. As shown in FIGS. 6 and 7, the suppressor 20' is shown which in one form is designed for a .223 rifle round (5.56 NATO) whereas the suppressor 20, for example, is shown in dimension for a rim fire .22 long rifle.

The suppressor device 20' is further shown with a cap region indicated at 36' which can be an integral part of the body 22' or a separate piece. In one form, the walls indicated at 50 can be angled so as to provide for a more desirable dissipation of energy of the expanding gases to each of the chambers 33' defined in part by the shroud 25' and the main body 24'.

As shown in FIG. 5, in general the inserts 24 in one form are provided with an annular flange portion 52 which are configured to be fit within the extending crossbar regions 27 of the frame 22. The transverse flange portion 54 is configured to rest upon the longitudinally forward portion of the crossbar regions 27, for example, as shown in FIG. 2. As described above, the flange portion is configured to have, for example, a set screw be positioned thereagainst for fixedly positioning the inserts to the frame 22. The plurality of inserts can be comprised of a harder metal than that of the material of the base frame.

Figure 14:
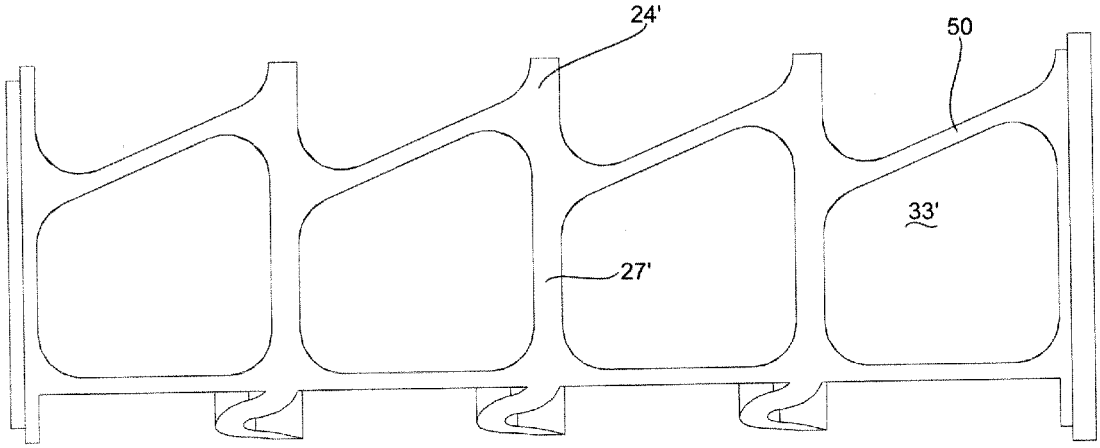
FIG. 14 shows an opposing side view of the base body where it should be noted that six orthogonal views are shown for purposes of properly illustrating ornamental design features of the base body.

As further shown in FIG. 2, the inserts 24 further generally comprise an annular central mount 60 which is positioned longitudinally between a projectile entrance portion 62 and a projectile exit portion 64. In general, the region between the projectile entrance portion 62 and the insert mount location 60 is a concave-type surface, as for example shown in FIG. 4 at the side profile 43. Now referring ahead to FIG. 7, there is shown a partially exploded view of the second embodiment of the sound suppressor device 20'. In general, the plurality of insert mount locations 66' are provided with various attachment mechanisms for having the inserts fitted therein. In one form, the surface substantially orthogonal to the central axis indicated at 68 (27' in FIG. 14) provides such a mount region. The area interposed between two adjacent inserts defines, in part, a primary chamber and more particularly a sub-chamber of the overall central primary chamber. Further, the baffle wall 68 is provided having a sinusoidal-type curvature in a direction substantially orthogonal to the central longitudinal axis and offset therefrom. The baffle wall 68 is positioned adjacent to a surface defining an access port to a secondary chamber, and more particularly sub-chambers positioned between adjacent baffle walls. The inserts 24' are provided with the opening 40 which defines a relief passage for communicating with the sub-chambers within the secondary chamber.

It should be further noted in FIG. 7 that the first oblique surface 74 is provided having surfaces defining ports 80 and 78 described herein. At interposed outward regions of the first oblique surface 74 is a third chamber region having various sub-chambers defined between the insert mount locations. In one form, additional surfaces defining access vents 80 can be formed.

Figure 8:
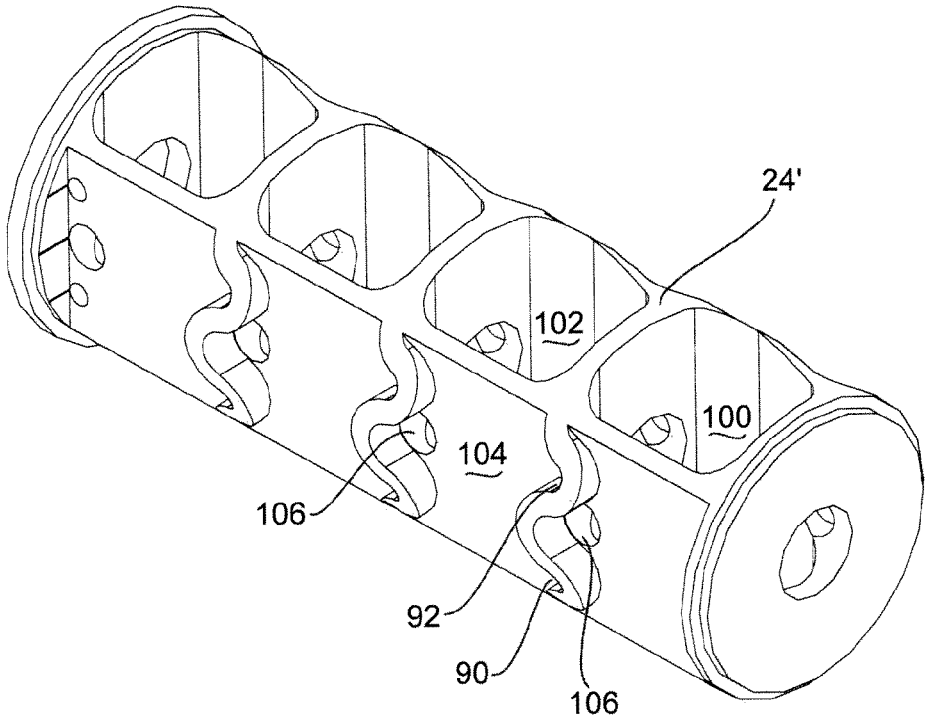
FIG. 8 shows an isometric view of the base body of the second embodiment showing in detail the various baffle-like members which in part form slipp chambers.
Figure 9:
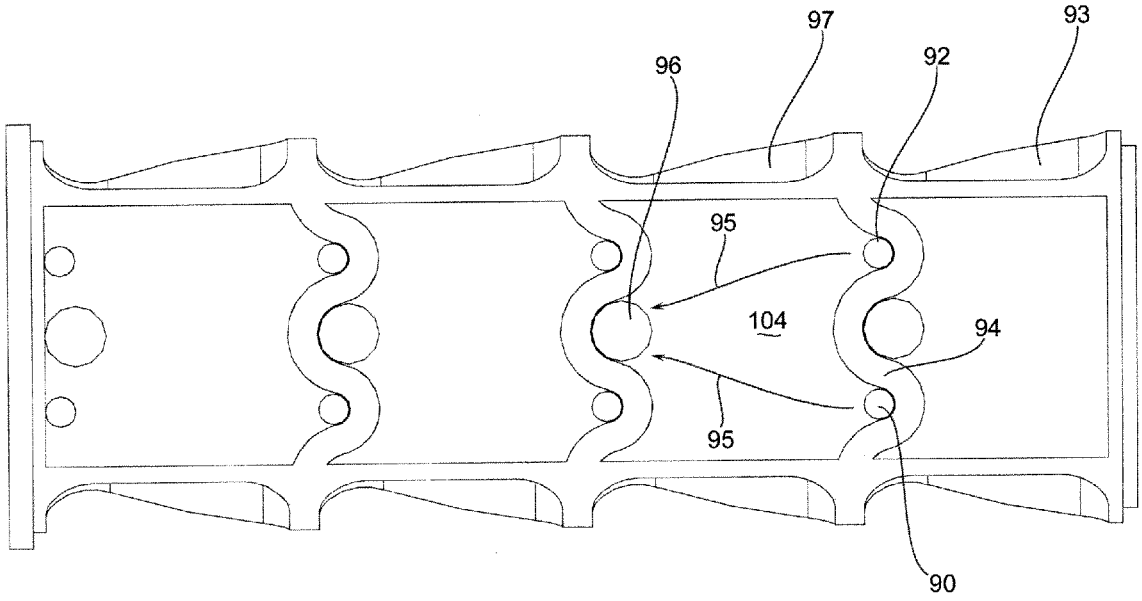
FIG. 9 shows a bottom view of the base body illustrating the gas flow through a slip chamber allowing an advanced amount of gas to flow to a longitudinally forward primary expansion chamber.
Figure 10:
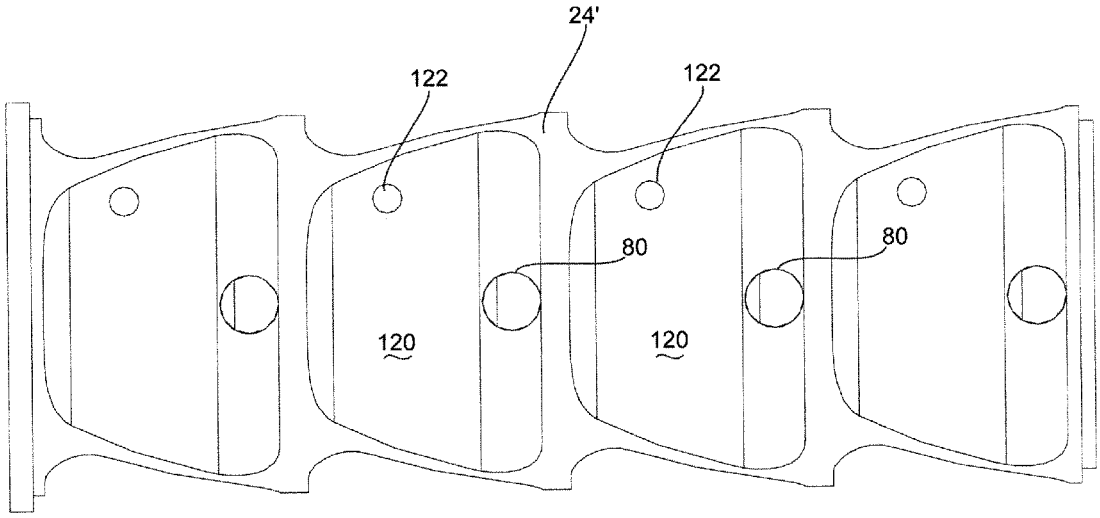
FIG. 10 shows a top view of the base body where the port 80 is provided to allow communication to a secondary chamber, otherwise referred to as a capacitance chamber, where it can be seen that a bleed-in vortex port is provided that is offset from the inserts placed therebelow.
Figure 11:
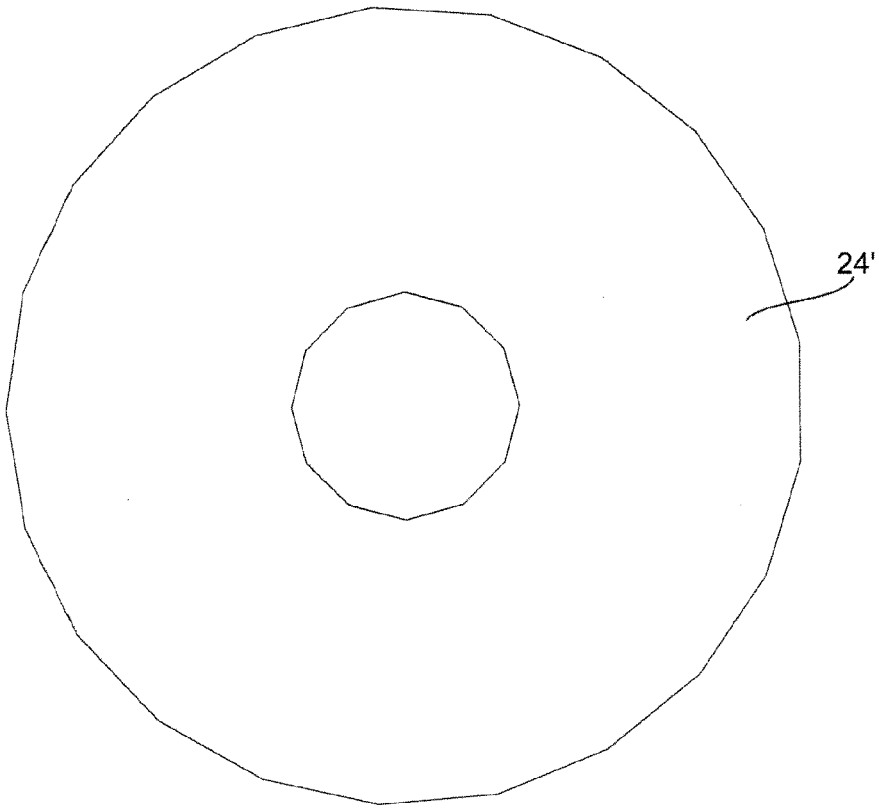
FIG. 11 shows an end view of the base body.
Figure 12:
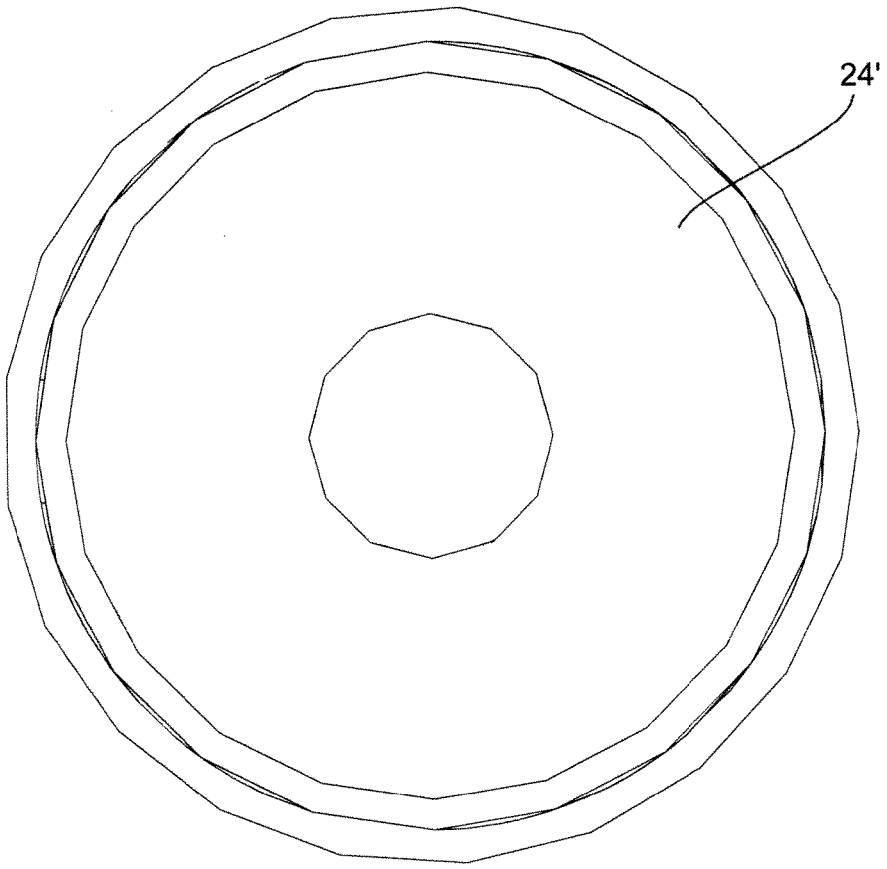
FIG. 12 shows an opposing end view of the base body.
Figure 13:
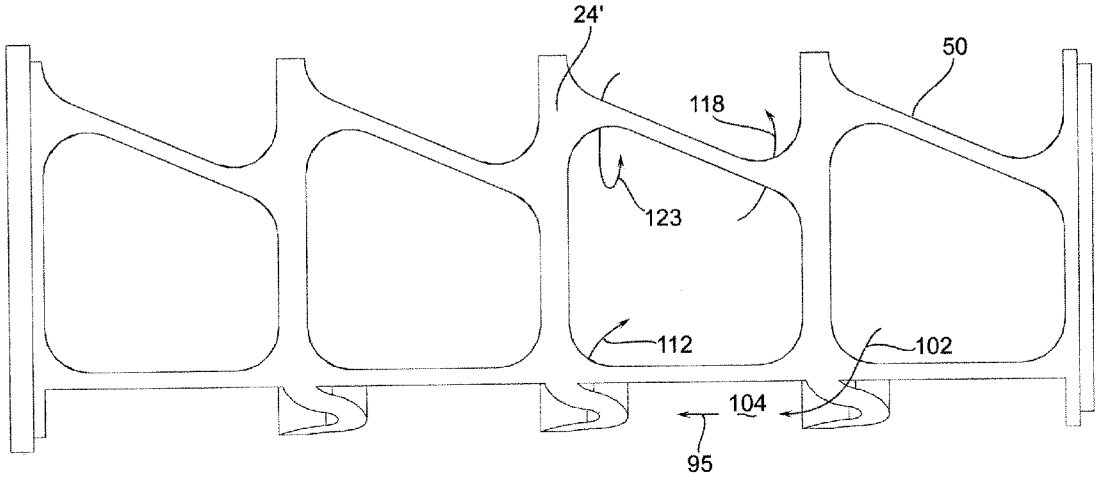
Figure 15:
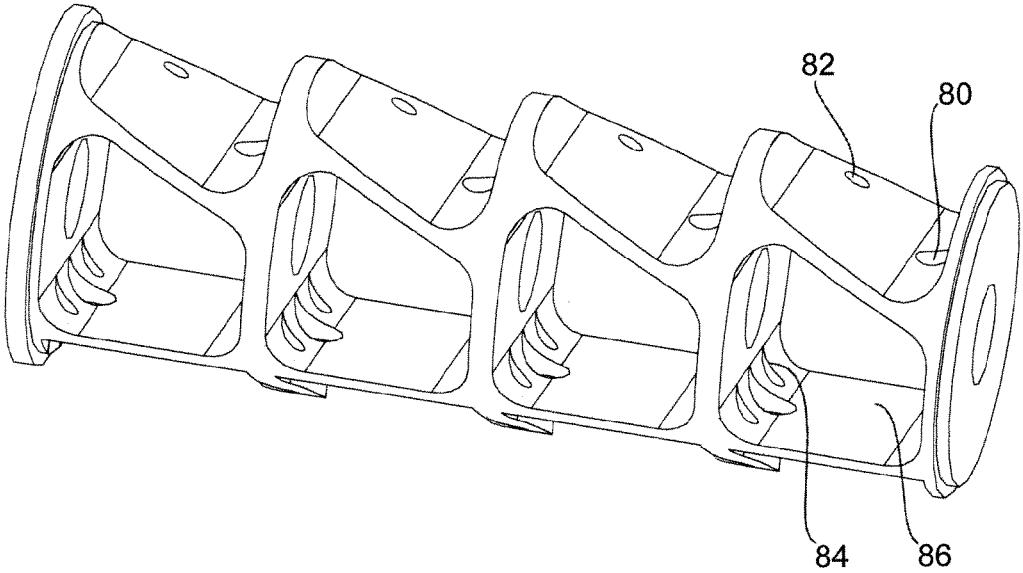
FIG. 15 shows another orthogonal view of the base body showing the various ports contained therein.

As shown in FIG. 15, there is a primary port 80 allowing a gas to enter therein, and a vortexing port 82 provided for possible swirling gas in the larger longitudinal forward portion 84 of the primary subchamber 86. As shown in FIG. 9, there are high-pressure ports 90 and 92 near surface 94 which are in communication with the first subchamber 93. In general, these high-pressure ports allow gas to flow as indicated by vectors 95 to pass through the low-pressure ports 96 (and 106 in FIG. 8 and FIG. 16) for allowing a certain amount of the expanding gas to pass therethrough to the second sub-chamber or chamber 97.

This gas entering 96 will throw forward into the other portion of the forward chamber 97. The objective is to use the angled side of the reservoir to receive gas therein. The side that has the flat portion allows gas to take a circuitous path forward through the suppressor 20.

Figure 16:
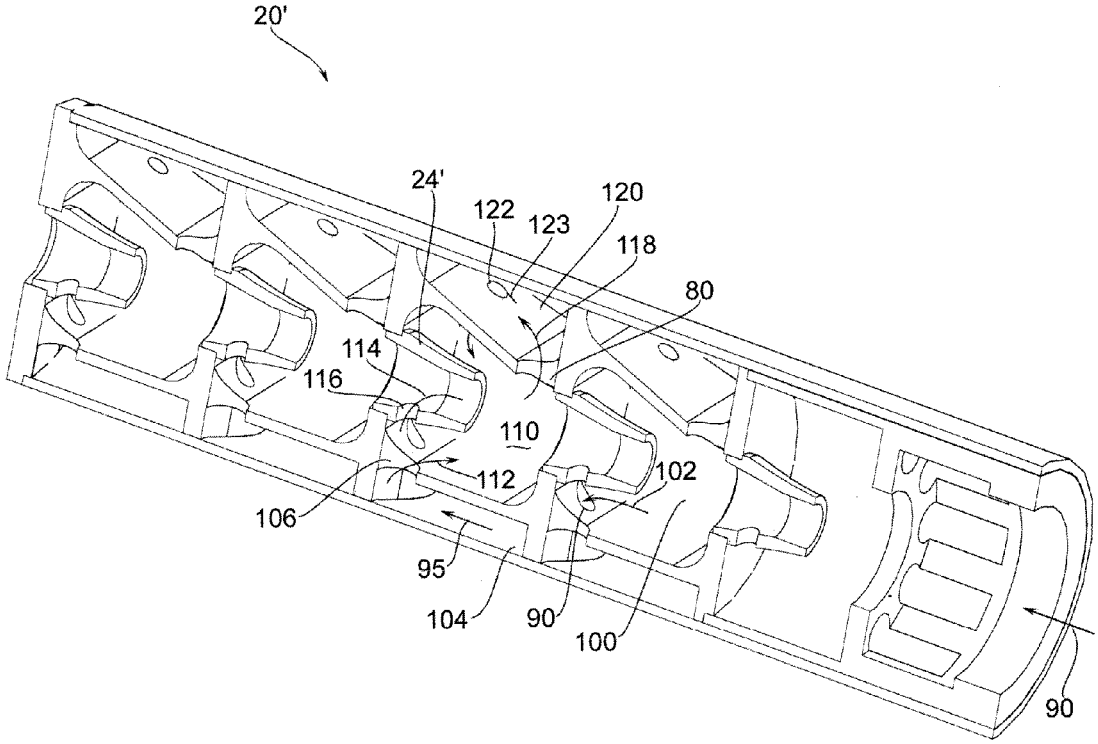
FIG. 16 shows a second cross-sectional view of the suppressor 20' showing various access ports in cross-sectional view and generally illustrating the concept of allowing the slip chamber to provide communication to a forward primary expansion chamber.

Now referring to FIG. 16, there is shown a sectional view of the firearm sound suppressor 20' where terminology will be added to describe certain general attributes of this design which generally illustrates the concept of allowing gas to advance into forward primary chambers. As shown in FIG. 16, in general it should be noted that a projectile will enter the suppressor 20' at the region indicated by the vector 90. Of course, there is a certain amount of pre-compressed gas in front of the projectile and also a certain amount of combusting trailing gas thereafter. As the compressed gas enters the first primary expansion chamber indicated at 100 (also referred to as a capacitance chamber), a certain amount of the gas will pass through the high-pressure ports 90 and 92 (see FIG. 9) where only the port 90 is shown in FIG. 16. The gas entering therethrough will pass into the slip chamber 104 as indicated by the vector 95. As noted in FIG. 9, the vectors 95 illustrate the flowing of gas through the slip chamber. Thereafter, the gas will travel through the advance port 96, otherwise referred to as the low-pressure port above, wherein the gas will enter the second primary expansion chamber 110, otherwise referred to as a longitudinal forward primary expansion chamber with respect to the first primary expansion chamber 100. The gas indicated by vector 112 will in general be directed to the central portion of the chamber 110, and further a portion of this gas is directed through the pre-load port 116 which is a portion of the insert 24'. The vector 114 illustrates the gas traveling through the pre-load port 116, and experimentation has found that this advance compressed gas provides utility in increasing the sound suppression. Present analysis indicates that this precompressed gas provides a certain amount of high-pressure gas that "races" the bullet through the slip chamber 104 so the pressure differential between the gas near the bullet and this advanced gas is less, thereby causing a lower pressure differential and hence lower expansive flows of compressed gas.

The high-pressure gas continues as indicated by vectors 118 and 123 therein within what is defined as the capacitance chamber 120. The capacitance chamber further is configured with a bleed-in vortex port 122 which feeds back into the primary chamber 110. In one form the port 122 is positioned laterally to the side (at least laterally with respect to the port 80), thereby creating what is believed to be an internal vortexing-like action within the primary chambers 110 (and 100 as well as the other chambers).

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art.

The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A firearms noise suppressor comprising:

a base frame comprising a longitudinally forward region and a longitudinally rearward region, the base frame having a central longitudinal axis, the base frame having a plurality of crossbar regions, wherein the crossbar regions include a plurality of insert mount locations spaced longitudinally along the base frame;

a plurality of inserts attached to the crossbar regions of the base frame at the insert mount locations, the plurality of inserts having a projectile entrance portion and a projectile exit portion, the plurality inserts each having an annular central mount wherein from the annular central mount to the projectile entrance portion the plurality of inserts each have an annular concave surface therearound, the plurality of inserts having an annular flange portion configured to fit within the insert mount locations in the crossbar regions and a transverse flange portion to rest upon a longitudinally forward portion of the crossbar regions;

a shroud positioned around the base frame and defining in part a primary chamber having sub-chambers between the insert mount locations of the base frame; and a containment cap to position the shroud around the base frame.

2. The firearms noise suppressor as recited in claim 1 where between the annular central mount and the projectile entrance portion of the inserts there is a surface defining a relief passage.

3. The firearms noise suppressor as recited in claim 2 where the surface defining the relief passage of the inserts provides a passageway to a surface defining a secondary chamber.

4. The firearms noise suppressor as recited in claim 3 where the secondary chamber is comprised of discrete subchambers separated by a baffle wall.

5. The firearms noise suppressor as recited in claim 4 where the baffle wall has a sinusoidal-type shape substantially perpendicular to the central longitudinal axis.

6. The firearms noise suppressor as recited in claim 1 where the base frame comprises surfaces defining a primary chamber where sub-chambers are defined between the insert mount locations of the base frame.

7. The firearms noise suppressor as recited in claim 6 where the sub-chambers are defined by a first oblique surface which provides a slant away from the central longitudinal axis from a longitudinal rearward portion of the sub-chamber to a longitudinal forward portion of the sub chamber.

8. The firearms noise suppressor as recited in claim 7 where a third chamber region is defined having a plurality of sub-chambers that are opposing the first oblique surface positioned radially outward of the first oblique surface.

9. The firearms noise suppressor as recited in claim 8 where a surface defining an access vent provides communication in the primary chamber to the third chamber region.

10. The firearms noise suppressor as recited in claim 1 where the plurality of inserts are removable from the crossbar regions of the base frame and can be replaced.

11. The firearms noise suppressor as recited in claim 10 where the plurality of inserts are comprised of a harder metal than that of the base frame.

* * * * *